US005654867A

United States Patent [19]

Murray

[11] Patent Number: 5,654,867

[45] Date of Patent: Aug. 5, 1997

[54] IMMOBILIZATION WEAPON

[75] Inventor: John H. Murray, Dana Point, Calif.

[73] Assignee: Barnet Resnick, Newport Beach, Calif.

[21] Appl. No.: 623,454

[22] Filed: Mar. 28, 1996

Related U.S. Application Data

[63] Continuation-in-part of Ser. No. 303,411, Sep. 9, 1994, abandoned.

[51] Int. Cl.[6] ..... H05C 1/04

[52] U.S. Cl. ..... 361/232

[58] Field of Search ..... 361/232; 89/1.11; 42/84, 1.08, 103; 429/1, 100

[56] References Cited

U.S. PATENT DOCUMENTS

| | | | |
|---|---|---|---|
| 3,722,788 | 3/1973 | Petrecz | 273/84 R |
| 3,803,463 | 4/1974 | Cover | 361/232 |
| 4,221,480 | 9/1980 | Sears | 429/100 |
| 4,253,132 | 2/1981 | Cover | 361/232 |
| 4,367,843 | 1/1983 | Bros et al. | 231/2 E |
| 4,688,140 | 8/1987 | Hammes | 361/232 |
| 4,752,539 | 6/1988 | Vatter | 429/1 |
| 4,846,044 | 7/1989 | Lahr | 361/232 |
| 5,103,366 | 4/1992 | Battochi | 361/232 |

*Primary Examiner*—Fritz Fleming
*Attorney, Agent, or Firm*—Leonard Tachner

[57] ABSTRACT

An electrical impulse-type immobilization weapon having both the capability for launching two tethered electrodes at a remote target, as well as for contacting, by means of two spaced apart contacts, a target located immediately adjacent the weapon. Furthermore, the present invention provides a novel manner for indicating whether or not launched projectiles have indeed impacted the target and have enabled the target to be subjected to an electrical impulse by establishing a current between the two projectile electrodes on the target surface. Furthermore, the present invention provides a sighting capability to increase the accuracy of target impact at a remote location. The sighting capability is provided herein by a pair of solid state laser devices mounted mechanically to the immobilization weapon in a manner which provides an accurate indication of the likely impact points for the remotely launched projectiles on a remote target. Still another highly advantageous feature of the present invention comprises a novel battery section structure which permits the battery to be installed into the immobilization weapon in only one direction, thus providing assurance that opposite polarity will not be inadvertently obtained during times of urgency or other stressful times when it is not convenient to carefully check the orientation of the battery as it is being installed.

4 Claims, 7 Drawing Sheets

IMMOBILIZATION WEAPON

BACKGROUND OF THE INVENTION

CROSS-RELATED APPLICATIONS

This application is a continuation-in-part of patent application Ser. No. 08/303,411 filed Sep. 9, 1994, now abandoned.

FIELD OF THE INVENTION

The present invention relates generally to the field of immobilization weapons of the type which impart an electrical impulse to immobilize a human target by inducing involuntary muscular contractions and more specifically to an improved immobilization weapon designed to impart such impulses by either launching a pair of wire tethered projectiles towards a remote target and then conduct an immobilization current through two impact points on the target, or by contacting a close target directly with a pair of contact rods which can also impart an immobilizing current. The present invention pertains to a number of significant improvements over the prior art of such immobilization weapons, including a means for indicating to the user when the target has not been subjected to the electrical impulses as intended, as well as means for sighting on the target at a distance to further enhance the accuracy of the projectile impact on the target. Still another feature of the present invention to be disclosed hereinafter is a means for accepting a battery in only one direction so that it is impossible to inadvertently connect the battery with a polarity opposite to that intended.

PRIOR ART

The present invention is specifically intended to constitute an improvement of the immobilization weapon disclosed in U.S. Pat. No. 3,803,463 issued Apr. 9, 1974 and now expired and U.S. Pat. No. 4,253,132 issued Feb. 24, 1981. The prior art device disclosed in these two patents and commercialized under the trademark "TASER" has become an immobilization weapon of choice for many police agencies and other law enforcement bodies because it imparts a temporarily debilitating electrical charge immobilizing a suspect, but without causing permanent injury or harm and giving the law enforcement officers sufficient time to handcuff or otherwise capture and secure a suspect with little or no risk of injury to the officer or the suspect.

Although the aforementioned TASER immobilization weapon has met with significant commercial success over approximately the past 20 years, its prolific use by numerous law enforcement agencies has resulted in the realization that certain improvements could increase the desirability and functionality of the TASER. One such improvement results from the desirability to have the option of either launching the two electrode projectiles towards a distant target, such as for example one which is about 15 feet from the TASER immobilization weapon or instead of launching such projectiles, to simply contact a target with current-carrying electrodes physically attached to the TASER. For example, the latter may occur when the target is immediately adjacent the law enforcement officer, such as during an altercation. In addition, it would be desirable to provide the law enforcement officer with some form of indication of whether or not the launched projectiles have hit their target to permit electrical current to be established between the projectiles across a portion of the target, such as for example, two points on the upper body of a suspect. This feature would be highly desirable, especially in cases where the distance between the target and the user or the light level makes it difficult to determine whether or not electrical impulses have actually been discharged at the target to immobilize the suspect. Still another feature which would be desirable to have in a TASER weapon of the type herein disclosed, is a means for sighting on the target to increase the accuracy of impact of the projectiles.

As disclosed in the aforementioned prior art patents, the TASER weapon operates in the field in an entirely portable fashion as a result of the use of a relatively low voltage battery, the output of which is converted to alternating current and then increased in voltage significantly by a transformer. Proper operation of the immobilization weapon requires that the battery be inserted into the device in a particular direction, that is to connect the battery with the appropriate polarity. Unfortunately, during the excitement of the moment and the stress involved in effectively reloading a TASER weapon with a new battery when necessary, occasionally the battery is connected with improper polarity, preventing proper operation and potentially creating a condition which can cause irreparable damage to the circuitry of the immobilization weapon. Accordingly, it would also be desirable to have a battery receiving structure within the weapon which would prevent such inadvertent reverse polarity connection of the battery even when the user cannot or does not have sufficient opportunity to check that the battery is being installed in the proper direction.

Based upon the foregoing, it is apparent that it would be highly desirable to have certain improvements to even further enhance the commercial success and functionality of an immobilization weapon of the type disclosed herein.

SUMMARY OF THE INVENTION

The present invention may thus be characterized as a significantly improved immobilization weapon of the type previously disclosed in the aforementioned prior art patents. The present invention provides an electrical impulse-type immobilization weapon having both the capability for launching two tethered electrodes at a remote target, as well as for contacting, by means of two spaced apart contacts, a target located immediately adjacent the weapon. Furthermore, the present invention provides a novel manner for indicating whether or not launched projectiles have indeed impacted the target and have enabled the target to be subjected to an electrical impulse by establishing a current between the two projectile electrodes on the target surface. Furthermore, the present invention provides a sighting capability to increase the accuracy of target impact at a remote location. The sighting capability is provided herein by a pair of solid state laser devices mounted mechanically to the immobilization weapon in a manner which provides an accurate indication of the likely impact points for the remotely launched projectiles on a remote target. Still another highly advantageous feature of the present invention comprises a novel battery section structure which permits the battery to be installed into the immobilization weapon in only one direction, thus providing assurance that opposite polarity will not be inadvertently obtained during times of urgency or other stressful times when it is not convenient to carefully check the orientation of the battery as it is being installed.

It will be seen hereinafter in more detail that dual operation of the present invention, namely both projectile remote target activation and local immediate direct contact activation, is achieved by applying the output of the high voltage portion of the present invention to both the projectile electrodes and to a pair of receptacle posts located at the top surface of the launcher portion of the invention and to which are connected a pair of contact rods. A unique feature of these contact rods is their flexibility without affecting their current carrying capacity. The flexibility feature of the rods enables the user to impart the immobilizing electrical impulses to a locally positioned target even when the target is moving back and increasing the distance between it and the taser weapon, thus making it more probable that the attempt to immobilize a locally positioned target will be successful. It will also be seen hereinafter that the posts to which the contact rods are connected also provide a pair of opposed discharge electrodes between which there is an electric discharge in the event that the launch projectiles do not both land on the target and thus enable the discharge to occur across the target surface as previously described. Thus, a discharge between the discharge electrodes provides an indication of whether or not the projectiles have successfully been deployed and the target has been subjected to an electrical impulse of the type disclosed herein and in the aforementioned prior art patents.

OBJECTS OF THE INVENTION

It is therefore a principal object of the present invention to provide an improved immobilization weapon of the type which uses a launching mechanism for propelling a pair of projectiles to a remotely positioned target to impart an electrical impulse between two points on the target to cause immobilizing muscular contractions.

It is an additional object of the present invention to provide an improved immobilization weapon of the aforementioned type wherein one such improvement comprises the dual capability of either launching projectiles to a remotely positioned target or utilizing contact rods for applying the aforementioned electrical impulses to a locally positioned target immediately adjacent the weapon.

It is still an additional object of the present invention to provide an improved immobilization weapon of the aforementioned type wherein the weapon is provided with an indicating device to alert the user of the weapon when there has been a failure to provide a discharge at a remotely located target, such as for example when a projectile has missed the target or has impacted a point through which electrical energy cannot be conducted.

It is still a further object of the present invention to provide a battery receiving structure within an immobilization weapon of the type for directing electrical impulses through a human target, the structure preventing inadvertent battery installation in an incorrect direction, otherwise causing an improper polarity connection between the battery and the weapon circuitry.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
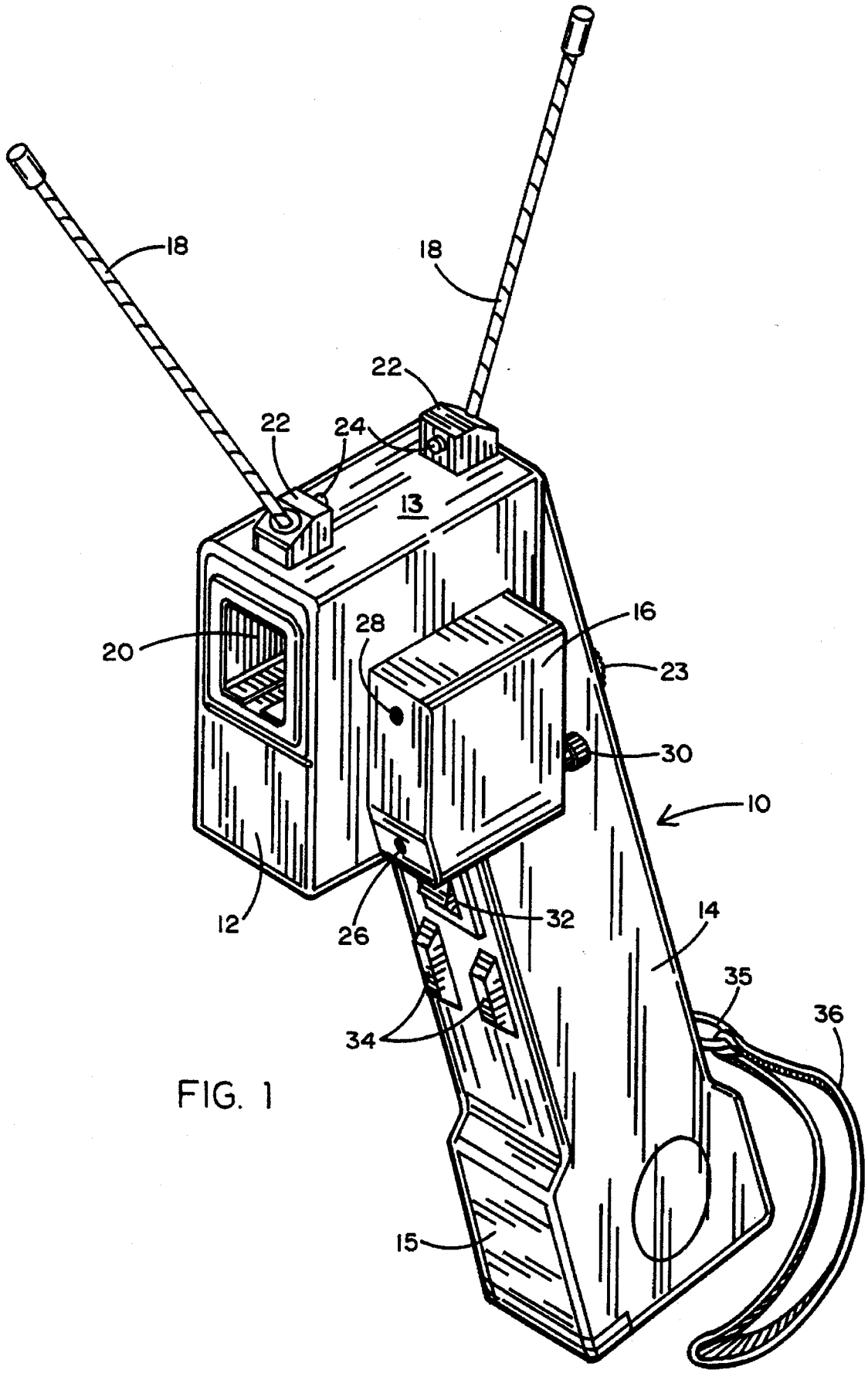
FIG. 1 is an isometric view of the improved immobilization weapon of the invention.

Referring now to the accompanying drawings, it will be seen that the improved immobilization weapon 10 of the present invention comprises a launching section 12, having a top surface 13 and a projectile launcher 20. The weapon 10 also comprises a handle section 14, a battery section 15 and a sighting section 16, the latter being optionally connected to the launching section 12 at a plurality of connecting recesses 17, as seen best in FIG. 2.

Figure 2:
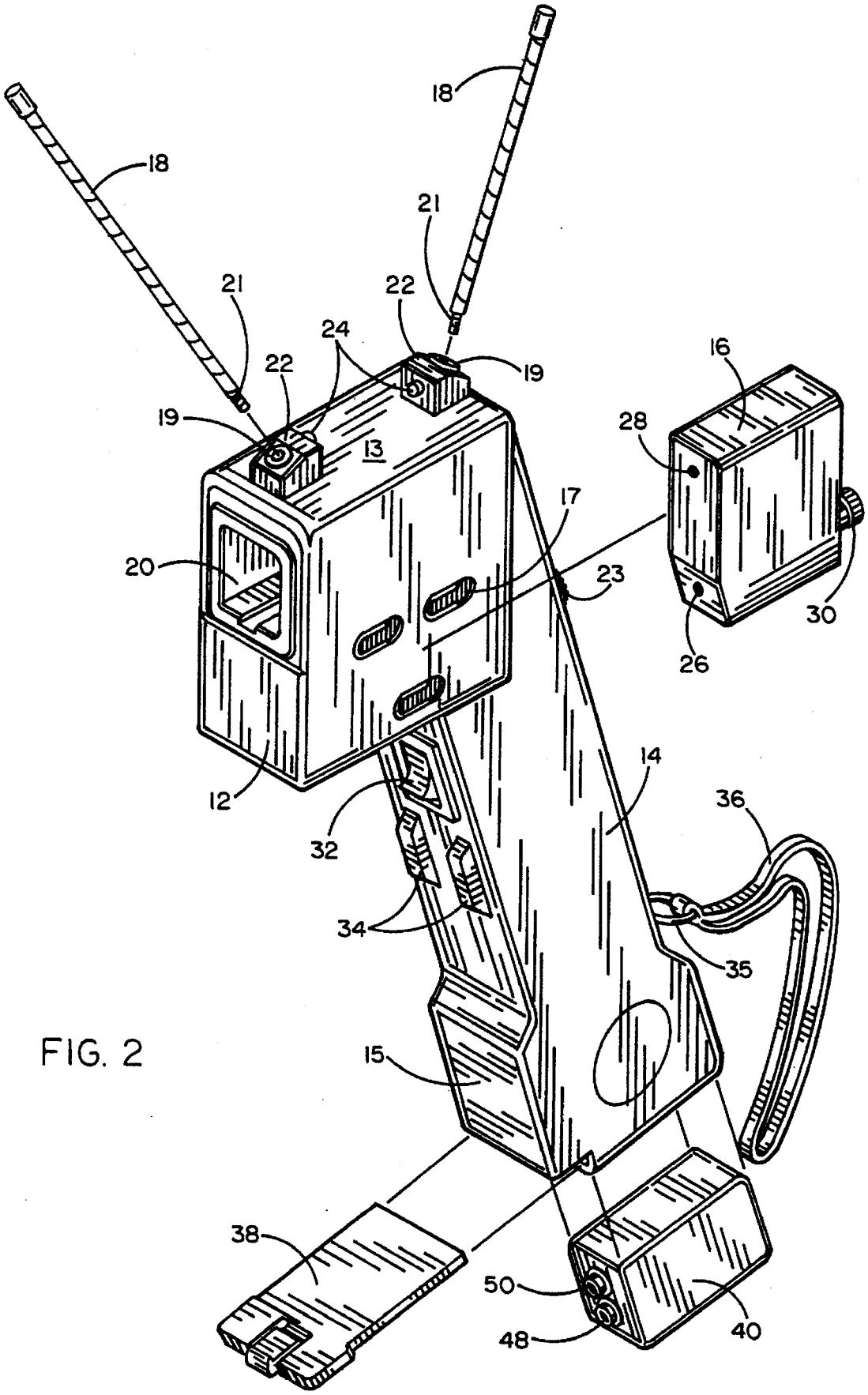
FIG. 2 is a partially exploded three dimensional view thereof.

As seen in FIGS. 1 and 2, the improved immobilization weapon 10 of the present invention also comprises a pair of flexible contact rods 18 which are threadably connected to a corresponding pair of rod receptacles 19 by means of threaded ends 21 of rods 18. The rod receptacles 19 are provided in a pair of receptacle posts 22 on the top surface 13 of the launching section 12. The receptacle posts 22 also provide a pair of opposed, spaced apart discharge electrodes 24, which are positioned on opposite ends of an air gap that is immediately above the plane of top surface 13. An electric discharge between electrodes 24 provides an immediate indication of a lack of remote target contact by launched projectiles.

Handle section 14 houses the primary electronics of the present invention, the details of which have been disclosed in prior art patents cited above and therefore need not be disclosed herein in detail. As seen in FIGS. 1 and 2, the handle section provides an on/off switch 23, an immobilization activation switch 32 and a pair of grip supports 34, as well as a connecting ring 35 which facilitates connection to a wrist strap 36. In the preferred embodiment of the invention, wrist strap 36 is connected to a "killswitch" (not shown) to automatically disable the weapon 10 if it is yanked away from the user. The bottom of handle section 14 terminates in a battery section 15 which is slightly larger in cross-sectional dimension to facilitate receiving a battery 40 which is secured in place within the battery section by a battery section cover 38.

Figure 3:
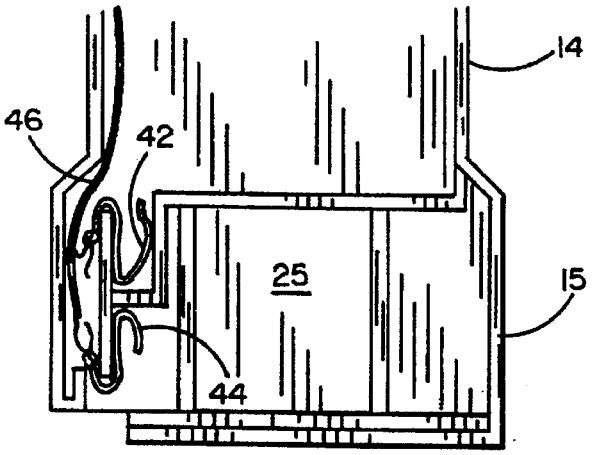
FIG. 3 is an internal view of a portion of the present invention containing the battery section thereof.
Figure 4:
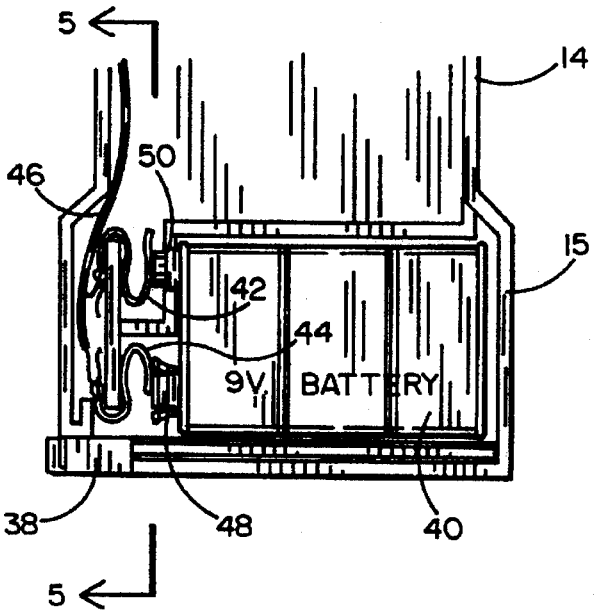
FIG. 4 is similar to that of FIG. 3, but showing the battery installed.
Figure 5:
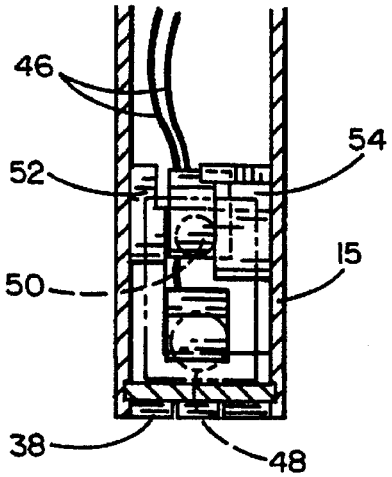
FIG. 5 is a cross-sectional view of the battery section of the present invention taken along lines 5—5 of FIG. 4.

The battery section 15 of the present invention will be best understood by referring to FIGS. 3 through 5. As seen in FIG. 3, battery section 15 comprises a battery chamber 25 which is adapted to receive a 9-volt size battery, capable of supplying the requisite minimum current for operation of the weapon 10. By way of example, a Mallory nickle-cadmium rechargeable battery, Model No. NC1604 has been found suitable for use in the present invention. Also contained within the battery section 15 is a pair of wire terminals, namely positive wire terminal 42 and negative wire terminal 44, both connected to the electronic portion (not shown) of the invention in the handle section 14 by means of a pair of wires 46.

As shown in FIG. 4, when a battery 40 is properly installed within the battery section 15, the positive terminal 50 of the battery is in contact with the positive wire terminal 42 and the negative terminal 48 of the battery is in contact with the negative wire terminal 44. As seen in FIG. 5, in order to assure that this is the only manner in which the battery 40 can be connected in the battery chamber 25, the present invention provides a unique pair of blocking brackets, namely first terminal blocking bracket 52 and second terminal blocking bracket 54. These blocking brackets are designed to permit the positive terminal of the battery to pass therebetween, but to prevent the negative terminal of the battery from doing so. As a result any attempt, inadvertent or otherwise, to connect the battery 40 in opposite polarity to that shown in FIG. 4 is physically impossible without actually breaking the brackets 52 and 54. Thus, it will be seen that the present invention provides a unique manner for assuring proper battery polarity when the battery 40 is installed in the battery section 15.

Figure 7:
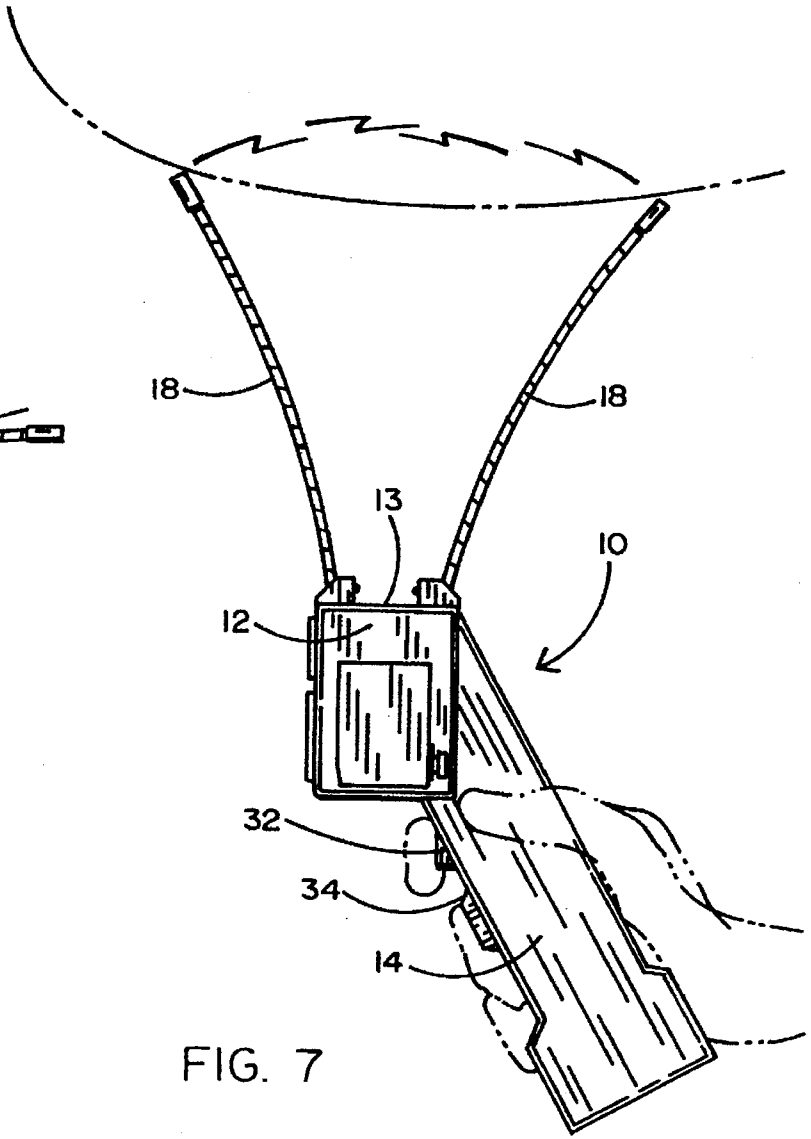
FIGS. 6 and 7 illustrate the use of the present invention for imparting an electrical impulse across two locations of a locally positioned target adjacent the weapon.
Figure 6:
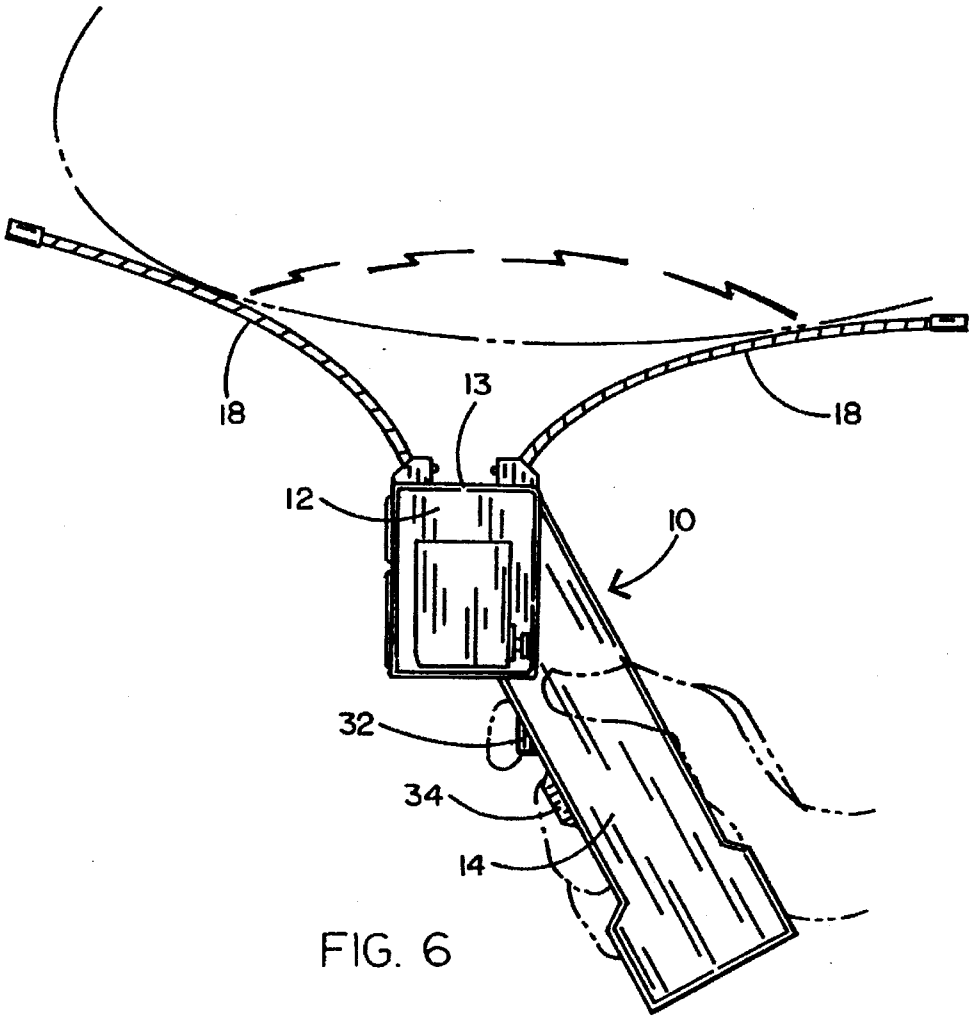

Reference will now be made to FIGS. 6 and 7 which illustrate the use of the contact rods 18 and the distinct advantage resulting from the unique flexible configuration of those rods. More specifically, as seen in FIGS. 6 and 7, a high degree of flexibility of the rods 18 (bendable to at least 120 degrees) enables the user to make contact with a locally positioned target and to maintain that contact even though the target attempts to withdraw from the weapon, such as shown sequentially in FIGS. 6 and 7. Because of the flexibility of the rods 18, the attempt by the target to withdraw from the weapon, permits the rods to change their degree of flexing and their contact points with the target, while still maintaining an electric discharge into the target as shown in those figures. Thus, it will be seen that in addition to the distinct advantage of having both local and remote target immobilization capabilities in the present invention, the unique flexible nature of the contact rods shown herein, makes the operation of the weapon 10 of the present invention even more advantageous than local discharge immobilization weapons which use non-flexible contact rods.

Figure 8:
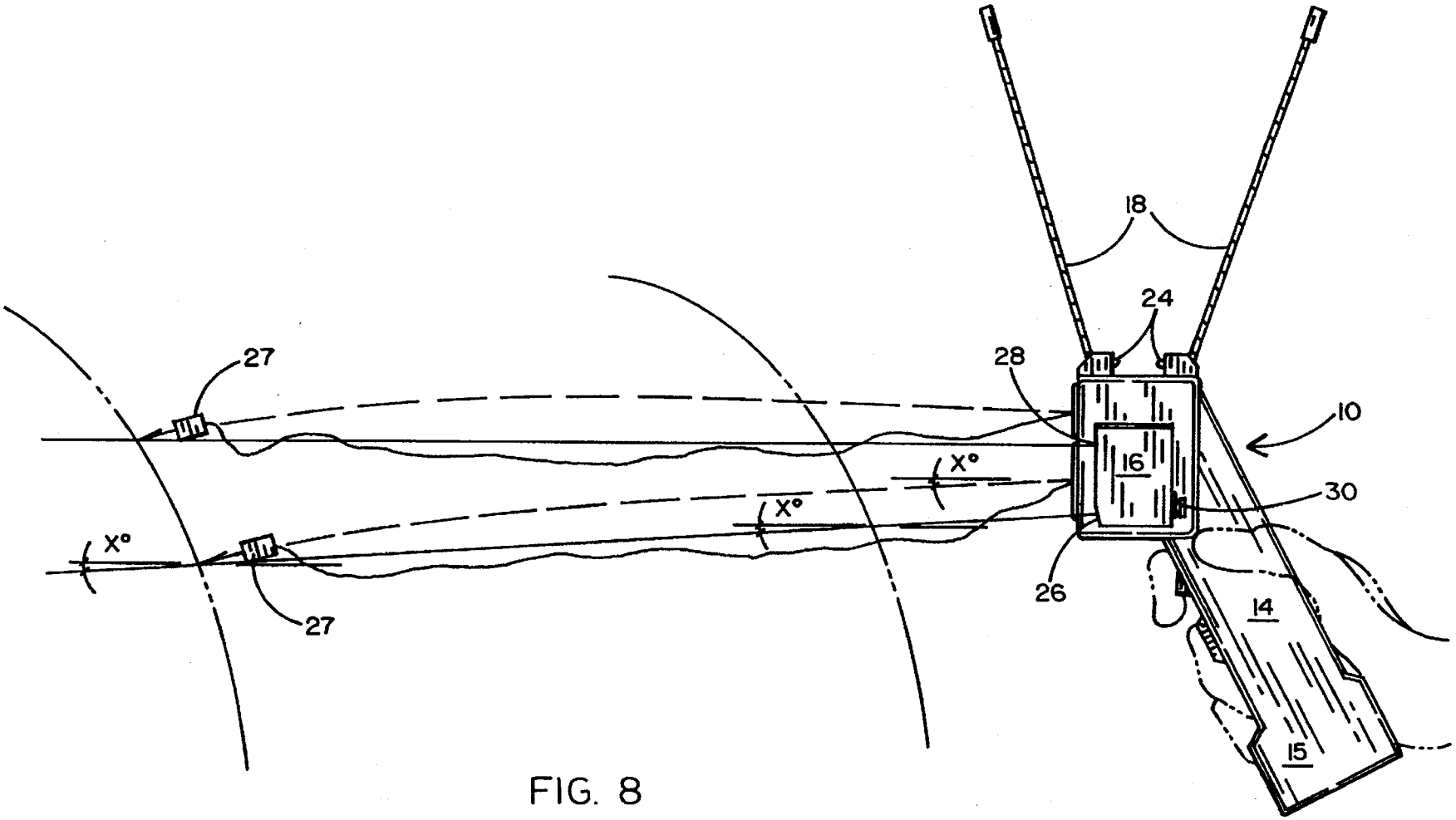
FIG. 8 is an illustrative view of the sighting section of the present invention, showing the manner in which an accurate indication of the distance between the likely projectile impact points is achieved.
Figure 9:
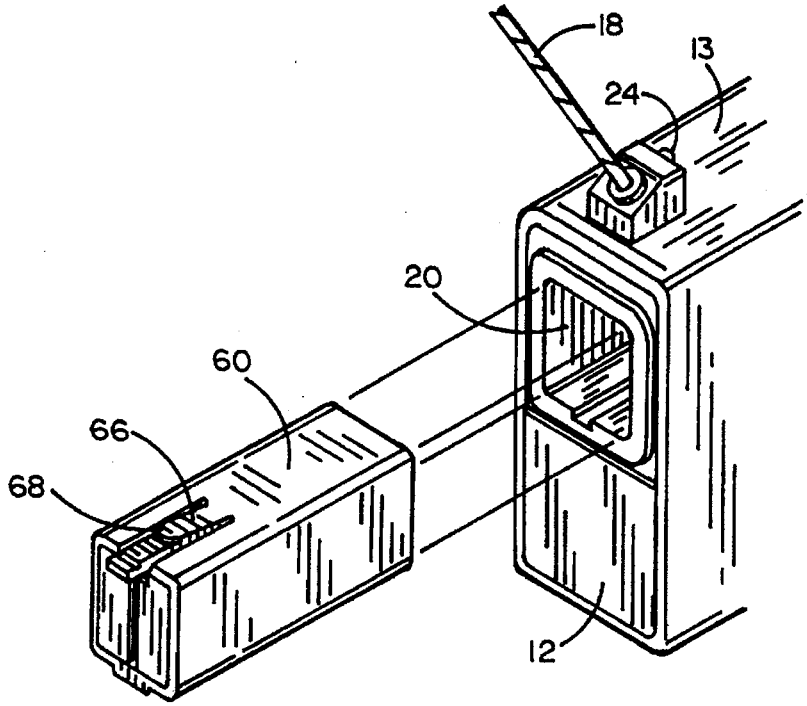
FIG. 9 illustrates the relationship between the projectile housing and the launcher of the invention.
Figure 10:
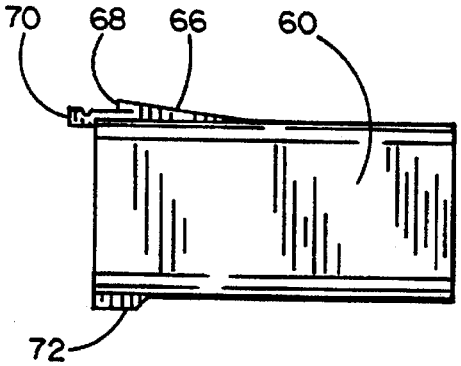
FIG. 10 is a side view of the projectile housing.
Figure 11:
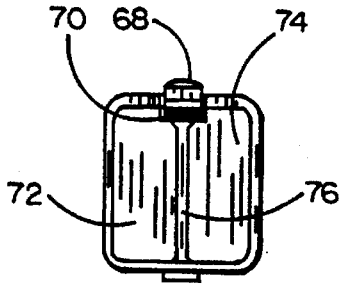
FIG. 11 is a front view of the projectile housing.
Figure 12:
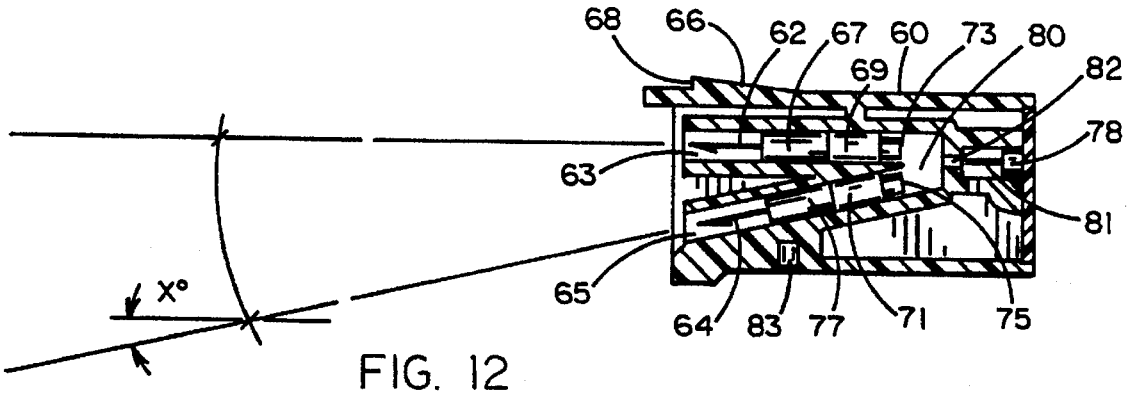
FIG. 12 is a cross-sectional view of the projectile housing.

Reference will now be made to FIG. 8 for a more illustrative description of the sighting section of the present invention. As shown in FIGS. 1 and 2, the sighting section 16 of the present invention comprises a separately powered self-sustained package having a pair of sighting apertures, namely first sighting aperture 26 and second sighting aperture 28, along with a sighting switch 30 which permits separate activation of the sighting section 16. Furthermore, it may be seen in FIGS. 1, 2 and 8 that the sighting apertures 26 and 28 are not positioned on a common plane, but are rather positioned on intercepting planes that create a non-zero angle x between the beams of laser light emanating from the respective apertures. In the preferred embodiment of the present invention, this angle is equal to the angle between the projectiles commonly used in the launcher 20, namely 12 degrees. The points of incidence of the laser light emanating from apertures 26 and 28 on a remote target, are positioned at a distance apart from one another, substantially equal to the distance between the projectiles that would impact the target if fired at the same distance to the target. Furthermore, it will be seen in FIG. 8 that because of this non-zero angle between the laser light beams emanating from apertures 26 and 28, a point of incidence for each of the laser light beams on a target relatively close to the weapon 10, is a smaller distance than the distance between those points of incidence on a target which is further from the weapon 10. This distance-dependent separation of light spots is substantially identical to the separation between the two projectile electrodes launched by launcher 20, impacting the target at corresponding distances from the weapon.

Reference will now be made to FIGS. 9–12 for a more thorough description of the projectile portion of the invention. As seen therein, the launcher 20 receives a projectile housing 60 containing the pair of projectiles 27. The projectiles comprise hooks 62 and 64, metal shoulders 67 and 77 and plastic shoulders 69 and 71. Packing material 73 and 75 secures the assemblied projectiles in a chamber 80. A primer 78 is in communication with chamber 80 by packing 81. A pin 82 and rivet 83 are connected to high voltage upon activation of switch 32 to ignite the primer and cause the projectiles to be forcefully propelled from respective passages 63 and 65 while trailing connecting wires 29 behind. As seen best in FIG. 12, the lower projectile and passage 65 are oriented at an angle x from the upper projectile and passage 63. This angle corresponds to the angle x between the sighting apertures 26 and 28 of sighting section 16 as noted in FIG. 8. Thus, one can anticipate that at a nominal distance of about ten feet, the hooks 62 and 64 will impact within a radius of a few inches of the location of beams from the sighting section 16. In the preferred embodiment of the invention shown in the accompanying figures, the angle x is about 12 degrees. The housing 60 is selectively secured in launcher 20 by a cantilever 66 having a catch 68 and a flange 70. A pair of press-fit face members 72 and 74 cover the exit surface 76 through which passages 63 and 65 extend.

Figure 13:
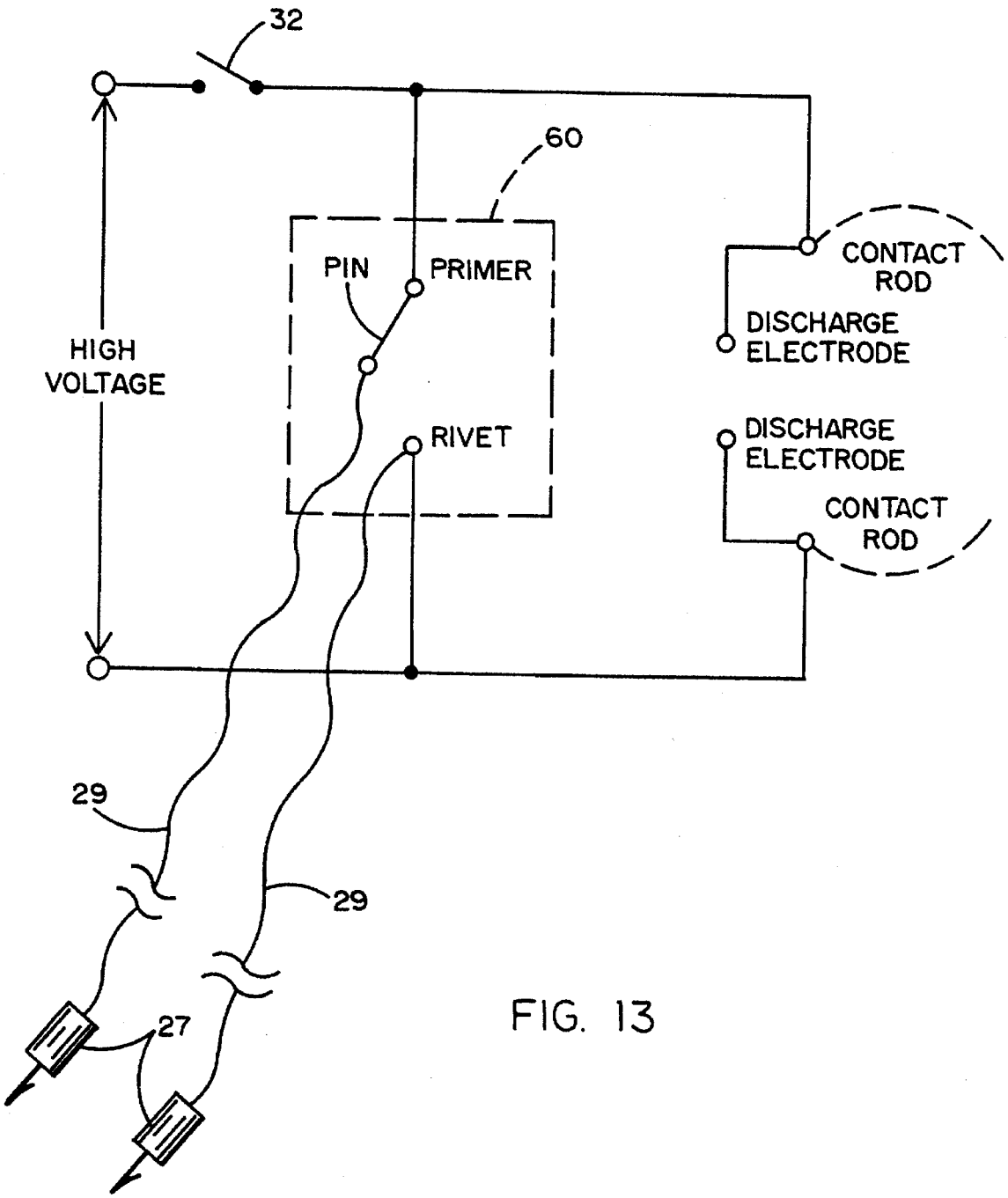
FIG. 13 is a simplified schematic drawing used to explain the operation of the discharge electrodes, contact rods and projectiles relative to one another.

FIG. 13 illustrates, schematically, the electrical relationship between the projectiles 27, the contact rods 18 and the discharge electrodes 24. Basically, all of these portions of the invention are connected electrically in parallel. When the projectile housing 60 is withdrawn from the launcher 20, only the contact rods 18 may be used to immobilize. Furthermore, if the projectiles 27 do not both contact a target, the close proximity of discharge electrodes 24 will permit a spark discharge across the electrodes thereby providing a signal to the user that the target has not received an immobilizing electrical pulse. On the other hand, if the projectiles do both reach the target, the lower resistance and consequent discharge across two impact points at the target will prevent discharge across electrodes 24.

From the foregoing it can be seen that the present invention comprises a number of significant improvements to the prior art TASER immobilization weapon which significantly enhance its performance as a remote target immobilization device. More specifically, the invention provides a combination of remote and local target immobilization capability with uniquely flexible local target contacting rods which further enhance the likelihood of effective target immobilization of locally positioned targets. Furthermore, it will be understood that the present invention provides the unique and immediate capability for the user to determine whether or not he or she has, in fact, effectively contacted a remotely located target with both projectile electrodes by simply observing whether or not a discharge occurs between discharge electrodes positioned along the top surface of the launching section in clear view of the user. Furthermore, it will be seen that the present invention provides a unique battery section which permits a 9-volt style battery to be installed in the weapon in only one direction, thereby assuring proper polarity for the electrical connection between the battery and the circuit therein, thus avoiding an inoperative condition or damage to the circuitry in the weapon. In addition, the present invention provides an optimal sighting capability for increased accuracy.

Those having skill in the art to which the present invention pertains, will now as a result of the applicant's teaching herein, perceive various modifications and additions which may be made to the invention. By way of example, the specific size, shape and materials of the components and various sections of the present invention may be readily altered without affecting the function or diminishing the advantages of the invention described herein in the form of an exemplary embodiment. Accordingly, all such modifications and additions are deemed to be within the scope of the invention which is to be limited only by the appended claims and their equivalents.

I claim:

1. In an immobilization weapon of the type having a launcher for launching at least one wire-tethered electrode toward a remotely-positioned target, and an electric circuit including a battery for imparting a selected electric discharge into such target through the electrode; the improvement comprising:

at least one conductive rod extending from said weapon and connected to said electric circuit for imparting said selected electric discharge into a target substantially adjacent said weapon;

further comprising at least one light source oriented on said weapon to generate a beam of light that is substantially co-linear with the path of said wire-tethered electrode after launching;

said weapon comprises two of said wire-tethered electrodes and two of said light sources, said electrodes being oriented at a first angle relative to one another, said light sources generating a pair of light beams oriented at a second angle relative to one another, said first and second angles being substantially identical whereby the separation between said light beams on said remote-positioned target is substantially the same as the separation between said electrodes upon their impact on said remotely-positioned target.

2. In an immobilization weapon of the type having a launcher for launching at least one wire-tethered electrode toward a remotely-positioned target, and an electric circuit including a battery for imparting a selected electric discharge into such target through the electrode; the improvement comprising:

a pair of electric discharge electrodes on said weapon, said electrodes being spaced apart a selected distance for permitting an electric spark to occur therebetween upon activation of said weapon without passage of said electric discharge into said target for immediately indicating a lack of target immobilization;

further comprising at least one conductive rod extending from said weapon and connected to said electric circuit for imparting said selected electric discharge into a target substantially adjacent said weapon;

further comprising at least one light source oriented on said weapon to generate a beam of light that is substantially co-linear with the path of said wire-tethered electrode after launching;

said weapon comprises two of said wire-tethered electrodes and two of said light sources, said electrodes being oriented at a first angle relative to one another, said light sources generating a pair of light beams oriented at a second angle relative to one another, said first and second angles being substantially identical whereby the separation between said light beams on said remote-positioned target is substantially the same as the separation between said electrodes upon their impact on said remotely-positioned target.

3. In an immobilization weapon of the type having a launcher for launching at least one wire-tethered electrode toward a remotely-positioned target, and an electric circuit including a battery for imparting a selected electric discharge into such target through the electrode; the improvement comprising:

at least one light source oriented on said weapon to generate a beam of light that is substantially co-linear with the path of said wire-tethered electrode after launching;

said weapon comprises two of said wire-tethered electrodes and two of said light sources, said electrodes being oriented at a first angle relative to one another, said light sources generating a pair of light beams oriented at a second angle relative to one another, said first and second angles being substantially identical whereby the separation between said light beams on said remote-positioned target is substantially the same as the separation between said electrodes upon their impact on said remotely-positioned target.

4. In an immobilization weapon of the type having a launcher for launching at least one wire-tethered electrode toward a remotely-positioned target, and an electric circuit including a battery for imparting a selected electric discharge into such target through the electrode; the improvement comprising:

a battery chamber in said weapon for receiving said battery; and at least one bracket in said chamber positioned for permitting insertion of said battery into said chamber in only one direction for assuring proper polarity of said battery in said circuit;

further comprising at least one light source oriented on said weapon to generate a beam of light that is substantially co-linear with the path of said wire-tethered electrode after launching;

said weapon comprises two of said wire-tethered electrodes and two of said light sources, said electrodes being oriented at a first angle relative to one another, said light sources generating a pair of light beams oriented at a second angle relative to one another, said first and second angles being substantially identical whereby the separation between said light beams on said remote-positioned target is substantially the same as the separation between said electrodes upon their impact on said remotely-positioned target.

* * * * *